US008690695B1

(12) United States Patent
Pittman

(10) Patent No.: US 8,690,695 B1
(45) Date of Patent: Apr. 8, 2014

(54) PORTABLE MODULAR WINTER SPORT TERRAIN SYSTEM AND METHOD FOR DEPLOYING THE SAME

(76) Inventor: Matthew L. Pittman, Bristol, CT (US)

( * ) Notice: Subject to any disclaimer, the term of this patent is extended or adjusted under 35 U.S.C. 154(b) by 203 days.

(21) Appl. No.: 13/080,368

(22) Filed: Apr. 5, 2011

Related U.S. Application Data

(60) Provisional application No. 61/321,373, filed on Apr. 6, 2010.

(51) Int. Cl.
*A63C 19/10* (2006.01)
*A63C 19/00* (2006.01)

(52) U.S. Cl.
USPC ..... 472/90; 14/69.5; 108/147.21

(58) Field of Classification Search
USPC ..... 472/88–91; 14/69.5; 108/129, 132, 108/147.21
See application file for complete search history.

(56) References Cited

U.S. PATENT DOCUMENTS 3,855,946 A * 12/1974 Bales ..... 108/147.21
5,562,052 A * 10/1996 Glashouwer et al. .... 108/147.21
D419,332 S * 1/2000 Collins et al. ..... D6/429
6,041,723 A * 3/2000 Peterson ..... 108/115
6,551,192 B1 * 4/2003 Rieber et al. ..... 472/88
7,299,754 B2 * 11/2007 Stanford et al. ..... 108/132
8,562,236 B2 * 10/2013 Eikelenboom ..... 403/81
2002/0187720 A1 * 12/2002 Engle ..... 446/85
2006/0174428 A1 * 8/2006 Swartz ..... 14/69.5
2010/0311510 A1 * 12/2010 Dickson et al. ..... 472/89

* cited by examiner

*Primary Examiner* — Kien Nguyen
(74) *Attorney, Agent, or Firm* — Loginov & Sicard; William A. Loginov

(57) ABSTRACT

This invention provides a terrain system comprising a set of metal tubes having a rounded cross section The tubes are separated at a width that defines the appropriate terrain. The tubes are supported by a base located on at least two spaced apart positions therealong. Each leg assembly includes a bottom bar that allows it to be implanted in packed snow. Optional outriggers can be attached to each side of the bottom bar so that the legs can afford increased stability. The legs include telescoping sections that allow for height adjustability. One leg can be omitted, thereby creating a ramp. Each end of the top portion contains male and female connection points, which accommodate curved end caps. Two end caps can also be joined with a double-axis hinge assembly that allows the adjacent top portions to be joined together and articulated along two parallel hinge axes.

12 Claims, 12 Drawing Sheets

PORTABLE MODULAR WINTER SPORT TERRAIN SYSTEM AND METHOD FOR DEPLOYING THE SAME

RELATED APPLICATION

This application claims the benefit of U.S. Provisional Application Ser. No. 61/321,373, filed Apr. 6, 2010, entitled PORTABLE MODULAR WINTER SPORT TERRAIN SYSTEM AND METHOD FOR DEPLOYING THE SAME, the entire disclosure of which is herein incorporated by reference.

FIELD OF THE INVENTION

This invention relates to winter sports equipment, and more particularly, to equipment for use by snowboarders and skiers.

BACKGROUND OF THE INVENTION

Since the earliest days of human history, man has sought to enjoy outdoor activities during the winter. There is evidence of early skiing going back many thousands of years. Recent technological advances have allowed skis to become shorter, smaller and more versatile and has allowed for the creation of sports such as freestyle skiing. Within the last half century, several pioneers have combined elements of skiing, surfing and skateboarding to create a new sport, snowboarding. The more freestyle elements of skiing and snowboarding have evolved into a form of daring acrobatic stunts and maneuvers.

Within the past twenty-five years, many ski areas have begun admitting snowboarders and skiers with shorter skis into their areas and have begun constructing fixed terrain parks for the enjoyment of this form of winter sport. The terrain park features can be enjoyed both by people on snowboards and people on shorter skis. Some of the terrain features include a rail, which is described as a metal bar, either rounded or with a small flat surface over which a skier or snowboarder can slide. This maneuver is called "gibbing". Another terrain feature is a box which is similar to a rail, but wider. This is similar to a "fun box" for skateboarding that the user can traverse it with skis or snowboards. There are jumps, half pipes and other large features that can be fashioned from snow, but the rails and boxes have to be prepared, either on site or moved from an offsite preparation area and securely fixed to the slope.

Terrain parks feature boxes and rails can either be on a slope or on a level area (known as a "flat"). The rails and boxes are typically accessed by a ramp of some form that can be constructed of snow or a substitute structure. A disadvantage is encountered by existing terrain parks is that the features are not stable own, as their bases need to be buried in snow and frozen in place to provided needed anchorage and stability, making them difficult to move after they have been set in place. Also, in many terrain park arrangements, the features are typically only useful in the winter season, and during the non-winter seasons structures are either moved to a nearby position, out of the active run, or simply left in place due to their heavy weight or bulk. While building a structure from lighter-weight materials would enhance portability (to some extent), it is desirable to construct the terrain features with heavy materials because the winter participants land with force onto the terrain feature. Thus, typical boxes and rails are constructed from sturdy materials that will not fall apart under repeated hard landings. Terrain features that are not well-constructed will become subject to fracturing, splintering and collapse, all of which pose a significant safety problem for both the participants and the property owners.

FIG. 1 is a view 100 of an exemplary terrain park 105, according to the prior art. In this terrain park 105, both a skier 110 and a snowboarder 112 are using the park simultaneously. The skier 110 has skied down to a ramp 114, which is composed primarily of packed snow and executed a jump which has brought him to the top of the "rail" 116. The exemplary rail 116 is a so-called "double barrel" construction composed of a parallel, closely spaced set of round, tubular steel rails 117 which are joined at their ends and supported by vertical stanchions 118. These stanchions can be secured against movement with respect to the slope 130 using a variety of conventional techniques (as described above). Alternately, a "single barrel" rail can be employed or an alternate rail geometry. The skier 110 is sliding downhill on the rail 116 and is oriented transversely in the alignment of his skis to the direction of travel 119. The snowboarder 112 has executed a jump from a packed snow ramp 120 onto the top of a "box" 122. This elongated rectangular structure is fixed to the slope. The top 124 is comprised of a slick material such as a polymer or smooth steel. The snowboarder 112 is traveling downhill on the box 124 in a direction 125. The snowboarder 112 is presently depicted as oriented in the direction of travel 125, but is able to execute spins or reversals of direction by various maneuvers.

Both the rail 116 and box 124 are finite structures. They are not readily enlarged, reduced or converted to a different use or configuration without disassembly and/or structural modification. Likewise, care must be taken to maintain structural strength and safety for the users through period maintenance, which can include replacement and/or reinforcement of various components—wood, in particular, has a tendency to deteriorate as a result of exposure to wetness and repeated stress. Such exposure occurs both during the snow season and thereafter, when the terrain feature's bulk limits or prevents it from storage out of the elements. This increases the cost of maintaining the terrain features and creates a stream of waste as old wood must be swapped out for new wood.

It is desirable to provide a system for constructing terrain parks, usable by a variety of winter sports enthusiasts that relieves the substantial impact on the terrain during non-winter months and that provides a more durable-long lasting structure requiring substantially reduced maintenance. This system should be easy to deploy and disassemble, provide for adjustability and be readily expandable to provide terrain park features for a variety of settings, from a home environment to a school or large resort.

SUMMARY OF THE INVENTION

This invention overcomes the disadvantages of the prior art by providing a sturdy, portable and modular terrain feature that can be deployed and used during the winter months and then removed and stored during the non-winter months. The winter sport terrain system is adjustable and can be modified to match the changing needs of the participants, events and the weather. Likewise, the terrain system permits the conversion from a box-like feature to a rail feature and back to the box in a convenient manner as situations and needs arise. Moreover, the system can be used safely and maintained during the winter months, while easily stowed in warmer times. The terrain system is portable and modular and can be deployed in a home or school environment, or large resort, during the winter months and then removed afterwards, so that the space can be converted into open space and more general outdoor/recreational use.

In an illustrative embodiment, the terrain system provides a top portion comprising an elongated surface (a rail, deck or other constructions). In an embodiment, the elongated surface defines a surrounding set of metal tubes having a rounded cross section. The rails are joined by cross supports. These cross supports can provide a base of a polymeric (or other material) deck that can reside slightly beneath the apices of the surrounding tubular border. The tubes are separated at a width that defines the appropriate terrain feature (a box, a rail, etc.). The deck is bolted to the cross supports. The tubes are supported by a base located on at least two spaced apart positions therealong. These bases allow for selective interconnection to associated leg assemblies with the top portion. Each leg assembly includes a bottom bar that allows it to be implanted in packed snow. Optional outriggers can be attached to each side of the bottom bar so that the legs can afford increased stability. The legs include telescoping sections that allow for height adjustability. This can be used to change the angle of the top portion with respect to the direction of gravity. One leg can be omitted from the top portion, thereby creating a ramp.

In an illustrative embodiment, each end of the top portion contains male and female connection points that mate either with an adjacent top portion to generate a double-length (triple length, etc.) structure, or to accommodate curved end caps. The end caps enhance the safety of the structure by providing rounded-over entrance and exit points for the skier/rider. In another embodiment, two end caps can be joined with a double-axis hinge assembly that allows the adjacent top portions to be joined together and articulated along two parallel hinge axes defined by each pivot of the hinge assembly. This arrangement allows one top portion to be folded against another in a stacked relationship, or a variety of other relationships between predetermined structures, including the ability to create adjoining decks that are in a particular angular relation with respect to each other. In general, the size and weight of the components of the system are arranged to allow for standard transport by current common carriers (United Parcel Service, for example).

BRIEF DESCRIPTION OF THE DRAWINGS

The invention description below refers to the accompanying drawings, of which.

DETAILED DESCRIPTION

Figure 1:
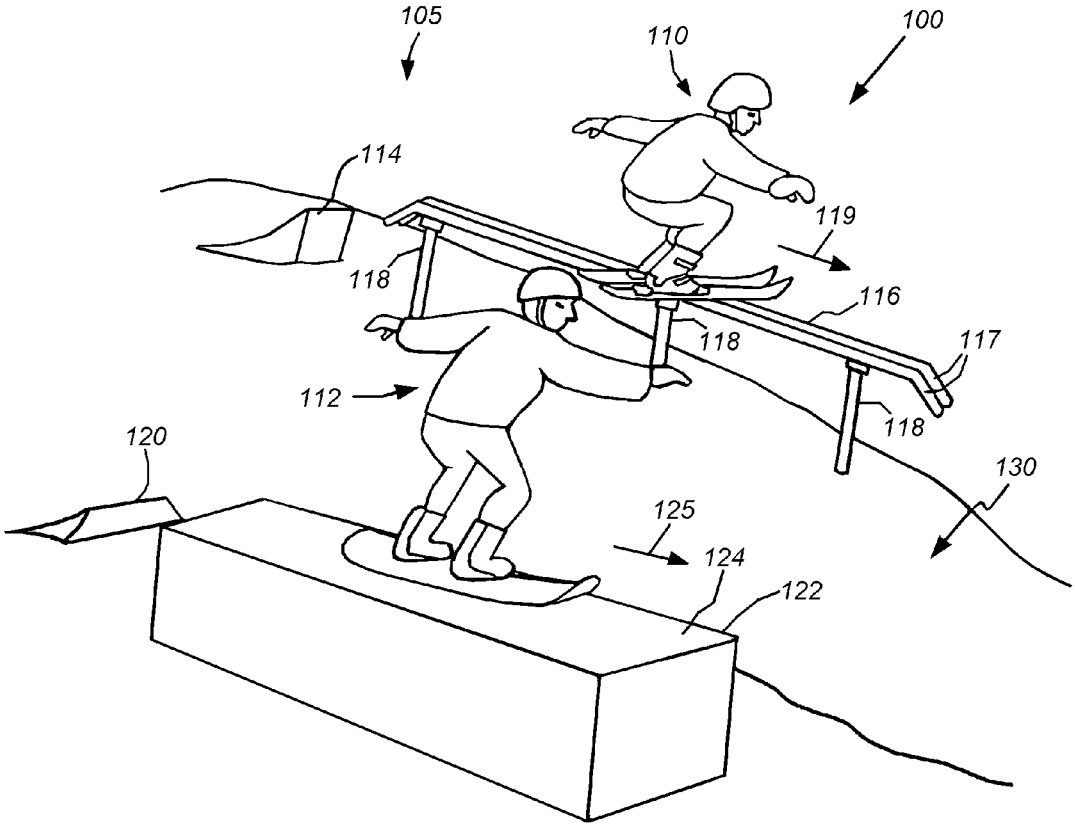
Fig. 1 (PRIOR ART)
FIG. 1, already described, is a perspective view of an exemplary terrain park, according to the prior art.
Figure 2:
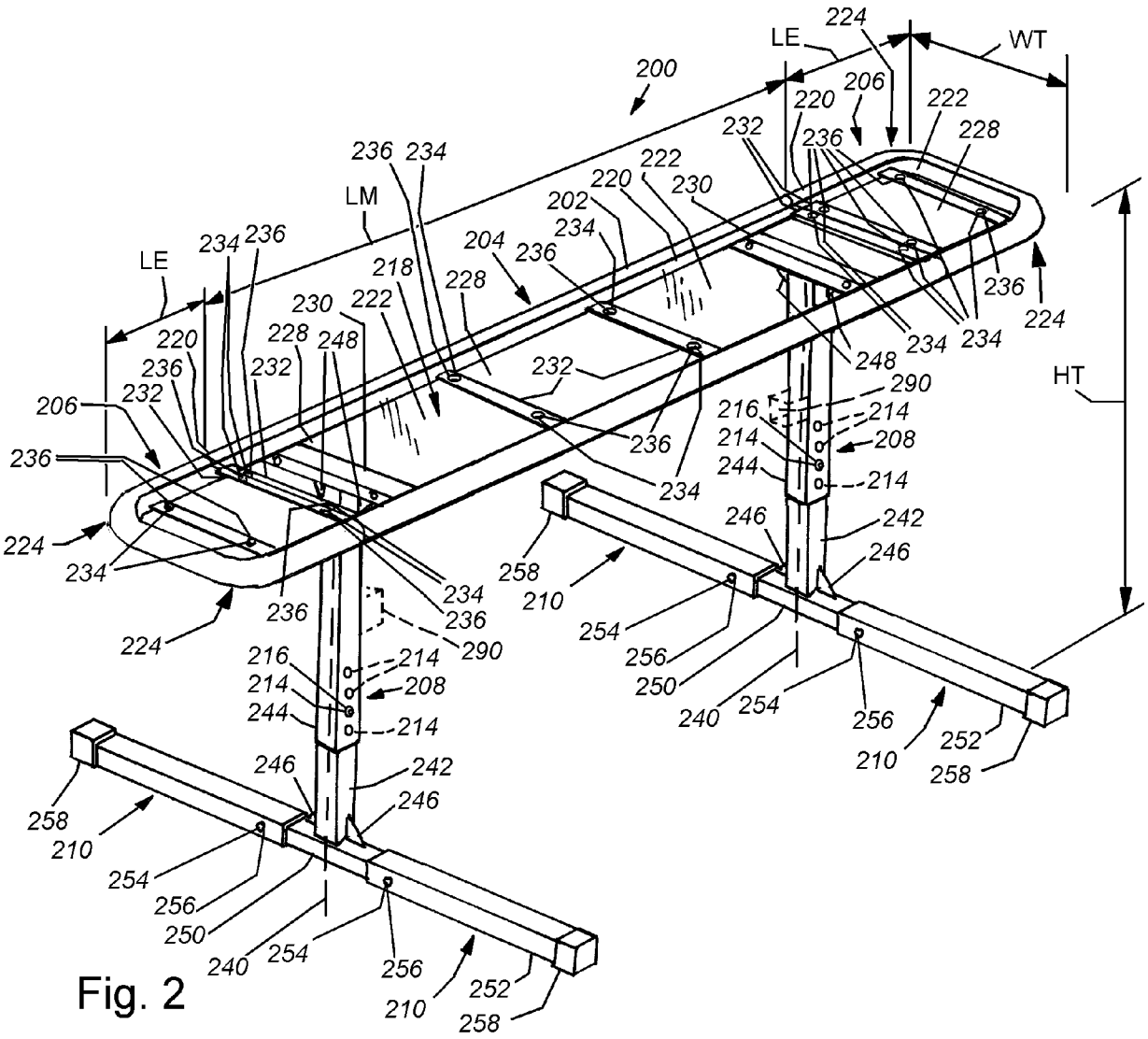
FIG. 2 is a perspective view of a portable modular winter sport terrain system, detailing various features, according to an illustrative embodiment.

FIG. 2 is a perspective view 200 of a portable modular winter sport terrain system, according to an illustrative embodiment. The shape of the terrain system 202 is rectangular and consists of a main body unit 204 and two interchangeable end caps 206. This terrain system emulates the 'box' of the prior art. The terrain system 202 includes two telescoping legs 208 that support the main body unit 204, and that are in turn supported by wide outriggers 210. Each of the legs 208 is furnished with a plurality of holes 214 set at regular intervals along this vertical member. The holes 214 accommodate a retaining bolt 216, or other through-fastener, that is locked in place with a nut (not shown) and provides for variable setting for the height of the mobile terrain system 202 and removal of the legs. The overall length LM of the main body 204 is approximately 8 feet long. The length LE of the end cap 206 is approximately 1 foot. The overall length of the exemplary terrain system 202 depicted in FIG. 2 is approximately 10 feet. The width WT of the terrain system is 16 inches and is uniform for both the middle body 204 and the end caps 206. The height HT of the terrain system 202 is variable between approximately 2 feet and 4 feet in an illustrative embodiment. The weight of the exemplary terrain system 202, as presented, is approximately 145 pounds.

Based upon current common carrier tariffs, a weight under 150 pounds qualifies for regular shipping methods and associated rates. Notably, alternate, commercially available snow boxes and rails currently lack the ability to disassemble or lay flat for portability. Conversely, the modular configuration of the illustrative embodiments of the system allows the user to efficiently transport and a box or rail system that is otherwise very unwieldy due to its size and shape. This location can be feet away or miles away due to the transportable shape that makes it easy to handle and also to load into a conventional cargo vehicle. Transport of the system is easily accomplished by simply removing the legs from the upper surface structure (box or rail) and/or separating the upper surface into individual sections. In this manner very long boxes and rails of 20 feet or more (when assembled) can be stored easily in disassembled form in a small shed. Likewise, the disassembled system can transported in small van-sized trucks that, absent modular construction, would require a tractor-trailer-sized vehicle to transport.

By way of definition, the terrain system 202 is deployed in a "use" configuration, meaning that it is ready to be used by sports enthusiasts. It can be dismantled and stored in a "stowed" configuration.

The snowboarders and skiers using the terrain system 202 can traverse (slide upon) the upper portion 218. It is desirable that this portion be relatively free of friction, as well as any contours that can cause the user to catch an edge and fall. The upper portion 218 is an elongated surface, which in this embodiment is defined by a tubular pipe border 220 and a flat deck 222. The border 220 is circular in profile so that sliding snow conveyances such as skis and boards cannot hang on any edge and users can traverse it safely. The corners of the end caps 224 are curved so that if a user falls or lands improperly on the terrain system 202, he or she cannot be gravely injured by the impact and the corners reduce the risk of a blunt trauma injury. The border 220 is composed of a longitudinally rigid material that has a characteristic flexibility (for example, steel tube having a wall thickness of 2 mils). It is critical that the material maintain flexibility at cold temperatures without becoming brittle. Materials that tend to splinter or fracture can cause injury to users as a result of failure after repeated hard landings.

The deck 222 is composed of a polymer that has the properties of remaining flexible even when cold (for example, high density polyethylene, HDPE). The thickness of the deck 222 is approximately 10 millimeters. The plane of the top surface of the deck 222 is depressed approximately 2 millimeters below the apex of the border 220. This provides for greater safety by eliminating a potential lip that would occur if the deck 222 were higher than the border 220, thus avoiding injury to users. The round border presents a minimal contact area between the snowboards or skis and the border. This provides for greater speed when the user traverses the terrain system 202 and better control when executing maneuvers, such as gibbing.

The terrain system 202 is secured in place on a ski slope, back yard or other suitable location. The securing can include covering outriggers 210 with a mantle of packed, wet snow, or in some cases the system can be used without anchoring it with snow. Rather, the outriggers can provide ample stability in and of themselves. The wet snow is desirably secured shoveled, plowed or blown. Packed, wet snow solidifies quickly into an encasing mantle having the consistency of concrete and can securely hold the terrain system. The depth of snow required is approximately one foot, depending upon its density. The advantage of solidified wet snow is that while it creates an encasing concrete-like mantle, it is readily chipped away and removed with shovels, axes, picks, ice axes, or another like tool. Once the encasing mantle is opened and the outriggers are freed, the terrain system can be modified, removed or relocated.

In an alternate embodiment, a translucent or transparent polymer is substituted for the material in the deck 222 and a light kit 290 (shown in phantom lines) is provided that can be affixed to pre-drilled/preformed mountings in the legs 202 with a waterproof battery source and LED lights creating a glowing deck during periods of reduced light, evening or night. This light set provides for additional safety to the users, as well as a pleasing visual effect for both users and those observing the user as they traverse the deck. By use of an addressable light source, such as an array of LEDs, the translucent deck can present a variable lighting effect in which colors change and move in accordance with a pre-determined program. For example, the deck can be programmed to generate the equivalent of a stream of airport runway landing lights. In another alternate embodiment, the material used for the border 220 and the deck 222 can be comprised of stainless steel or a similar material. Alternatively, two or more main body units 204 can be joined together, end to end, creating a longer terrain system, as will be described more fully below. Likewise, a transparent or translucent polymer, with or without illumination, can be used in combination with reverse graphics to create a brand, advertisement or other graphical display on the deck 222.

The top 218 of the terrain system 202, comprising the border 220 and deck 222 is supported by a support member 230, welded to the top of each of the legs 208. The support member 230 is bolted to the border 220 with bolts (not shown). The deck 228 of the middle body 204 is supported by at least four deck support members 232. Each of the deck support members 232 is welded at its end to the border 220 which provides for rigidity along the length of the terrain system 202. Each of the deck support members 232 is provided with at least two holes 234 and two deck locking bolts, and elastomeric (Neoprene® washers) (not shown). The deck locking bolts are not snugly tightened, so that there is a small amount of movement up and down, and side-to-side, afforded for the deck 228 with respect to the underlying deck support members 232. There is a stand off gap between the deck 222 and the border 220 of approximately ⅛ inch. The stand off gap between the deck 222 and the border 220, combined with the loose setting on the deck locking bolts 236 provides for expansion and contraction during cycles of changing temperatures and sunlight, given the dissimilarity of the border and deck materials.

Repeated impacts from boarders who are landing on the top surface 218 after leaving a take-off ramp (not shown) requires that the terrain system 202 remains stable and maintains its structural integrity. This structural integrity is maintained by the welds on the various ends of the legs 208, the bolts 214 on the telescoping vertical legs, as well as the bolts at either end of the support stanchions 230. In an illustrative embodiment, the telescoping legs are square in profile and composed of 2 mil steel. Each of the support legs is approximately 2-4 inches on a side. The legs are sufficiently flexible to provide for a small amount of flexure along their vertical axis 240. This prevents fracture and failure of the system. As stated above, the material employed is metric steel, which is dimensioned to allow for the telescoping of the lower leg 242 into the upper leg 244, due to the inherent nesting of sizes available with such material stock. The bottom of the lower leg 242 is provided with two triangular supports/gussets 246 that are welded to both the lower leg 242 and the center of the outriggers 250 where they interconnect with the outrigger 210. The upper leg 244 is provided with two triangular support braces/gussets 248 that are welded to the support stanchion 230. The center of the outrigger 250 is telescoped within the outer outriggers 252 and is held in place by a through bolt 254 that is retained in a through hole 256. Each of the outriggers 252 is provided with an end cap 258. It should be noted that in alternate embodiments, the cross section of members can vary. In addition, the dimensions and connections between components can be varied to achieve the same function as described above. In an alternate embodiment, the outriggers can be formed of a single homogenous unitary member.

When deployed, the terrain system 202 is placed onto the terrain of the hill or flat and snow is then optionally packed around the legs 208 and outriggers 210 such that they are locked in place. It should be clear that the outrigger system provided in the illustrative embodiments advantageously allows the user to set up the system in areas having very little or no snow while maintaining a desired level of stability. This feature is desirable for a number of specialized applications, such as traveling rail jam exhibitors who require setup on a variety of terrain and snow conditions, as well as summer practice on snow alternative surfaces. By way of comparison, alternative designs for commercially available boxes and rails rely mainly on the packing of snow around the base of the box or rail and then "icing in" the base using salt and/or water to melt and refreeze the stabilizing material. This may prove inconvenient or highly difficult to accomplish for a traveling event or temporary setup, where there is a lack of adequate time or snow conditions for a proper icing process to occur. A more general advantage provided by the outriggers is that they effectively counteract the forces that can vary due to the adjustability of the unit's height, while enabling portability. Counteracting of a range of forces due to adjustable height is not a consideration in a mountain-fixed unit or snow-packed feature.

Likewise, the novel height adjustment feature provided to each leg of the system affords significant versatility not available to a skate box or rail unit, which are often fixed in height at approximately ten inches. Since the illustrative portable system is designed to be used in snow must be made to accommodate the specific requirements and challenges presented by these variable conditions. In illustrative embodiments, leg height adjustability of the system can be set to a variety of values within a range of approximately twenty to forty inches. Alternatively, the legs can be removed entirely from the overlying top portion (including a deck surface, rail, etc.) to provide (for example) a ride on feature, in which the top portion is placed directly on the snow or other substrate. This can allow for training of, for example, entry level athletes in a manner that allows them to become familiar with the experience of sliding on a foreign surface without the fear/risk of falling from a raised surface. Moreover, when the legs are fitted, their height-adjustability allows the system to accommodate different snow depths and/or different user skill levels.

Figure 3:
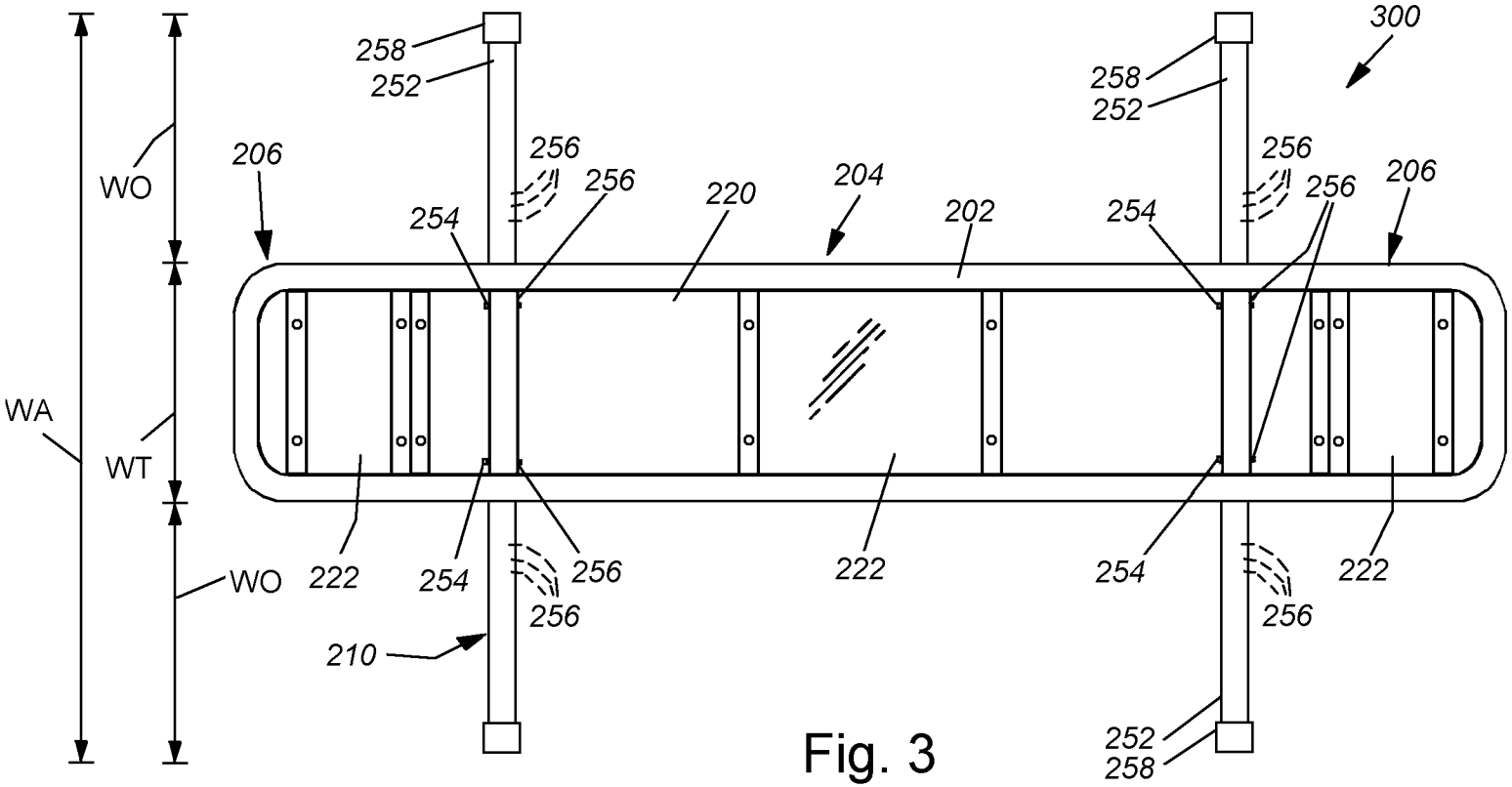
FIG. 3 is a top view of the illustrative portable modular winter sport terrain system of FIG. 2, detailing the overall features.

FIG. 3 is a view 300 that looks down onto the exemplary arrangement of the terrain system 202 of FIG. 2, according to an illustrative embodiment. The deck 222 and border 220 of the terrain system 202, as stated previously, have a combined width WT of approximately 16 inches. The outriggers 210 extend outwards from both sides to an additional width WO of approximately 16-18 inches per side. The width WT of the terrain system 202 and the width WO of each of the outriggers 210 provides for an overall width WA of approximately 48 inches. Note that the dimensions described herein are exemplary of a wide variety of possible sizes, depending upon the overall scale and size of the system being employed.

Figure 4:
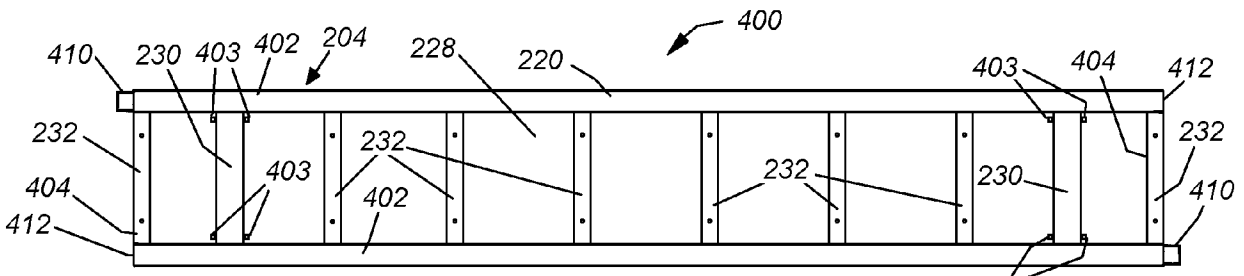
FIG. 4 is a plan view of the top of the portable modular winter sport terrain system of FIG. 2, detailing the underlying support for the deck.

FIG. 4 is a schematic view 400 of the middle portion 204 of the exemplary terrain system of FIG. 2, according to an illustrative embodiment. The illustrative deck 228 is supported by eight deck support members 232. The segments 402 of the border 220 are connected to the stanchions 230 and are secured by bolts 403 to the sides of the border. The outer deck support members 404 are flush with the end of the deck 228. Each end is provided with a male junction 410 and a female socket 412. The male junction 410 is a necked tubular extension from the border segment 402, and it is sized so as to fit into the female socket 412 of the next segment. The locking of male junction 410 into the female socket 412 provides for a secure continuation of the border. A male junction 410 and a female socket 412 are uniformly placed on both the opposing end caps (not shown) and opposing ends of the middle sections 204 such that a variable number of middle sections 204 can be joined together and end caps provided in an interchangeable manner. The end caps can also be exchanged if desired from one end of the terrain system 202 to the other and back again. The joining of the end caps to the main body is described more fully below. Where metric size tubing is employed, male connectors can be constructed from a nesting tube size that is welded or fastened within the outer tube that forms the end of the structure.

Figure 5:
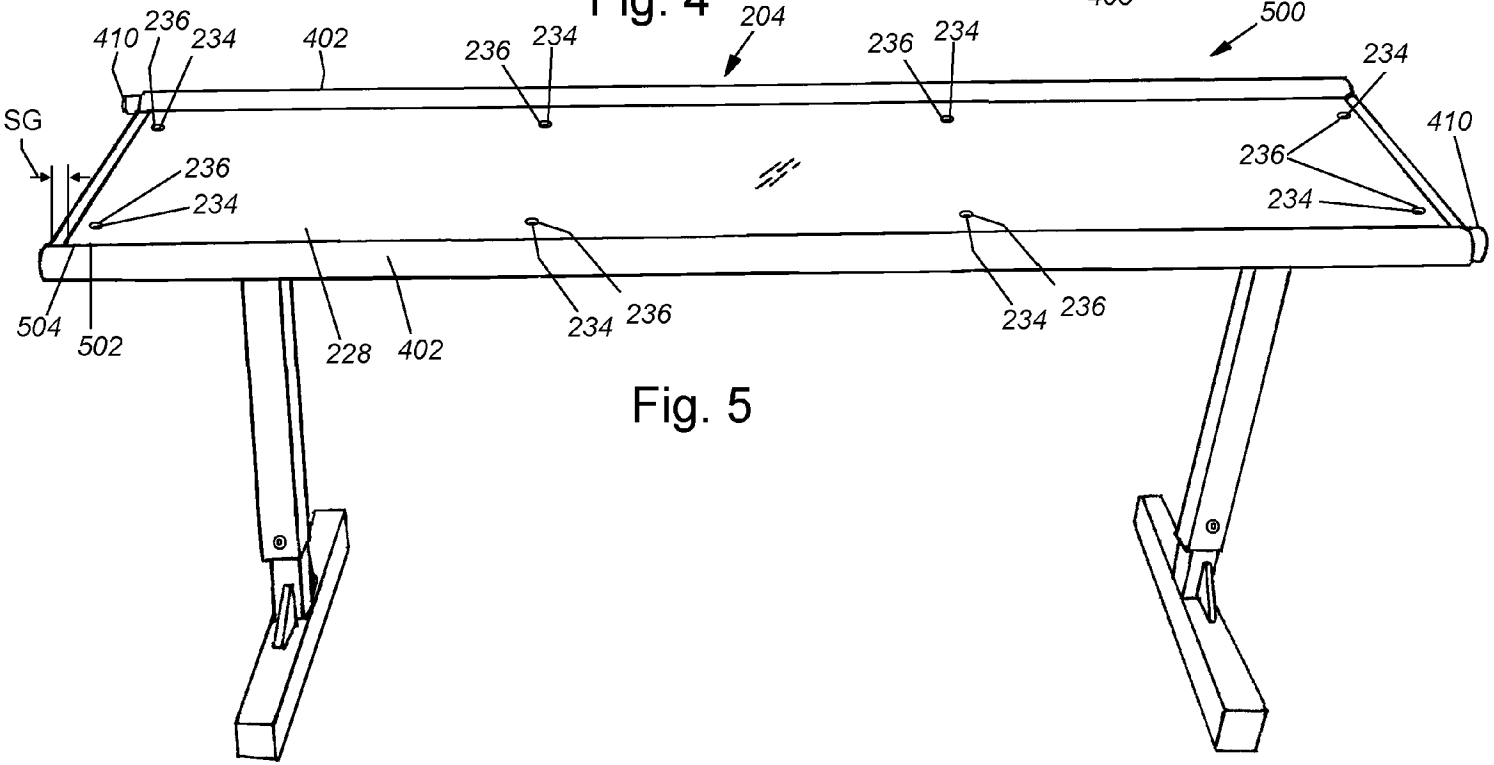
FIG. 5 is a frontal perspective view of the portable modular winter sport terrain system of FIG. 2, detailing the features of the deck.

FIG. 5 is a frontal perspective view 500 of the middle body 204 of the exemplary terrain system of FIG. 2. As noted above, the deck 228 is secured by through bolts 234 recessed into holes 236 that attach to the deck support stanchions (not shown). As described previously, there is a standoff gap between the outer perimeter 502 of the deck 228 and the inner surface 504 of the border 402. The recessing of the bolts ensures that they do not meet the surface of the deck and do not interfere with the traversal of a user cross the top surface of the terrain system. In an alternate embodiment, the holes can be provided with removable, flush plugs.

Figure 6:
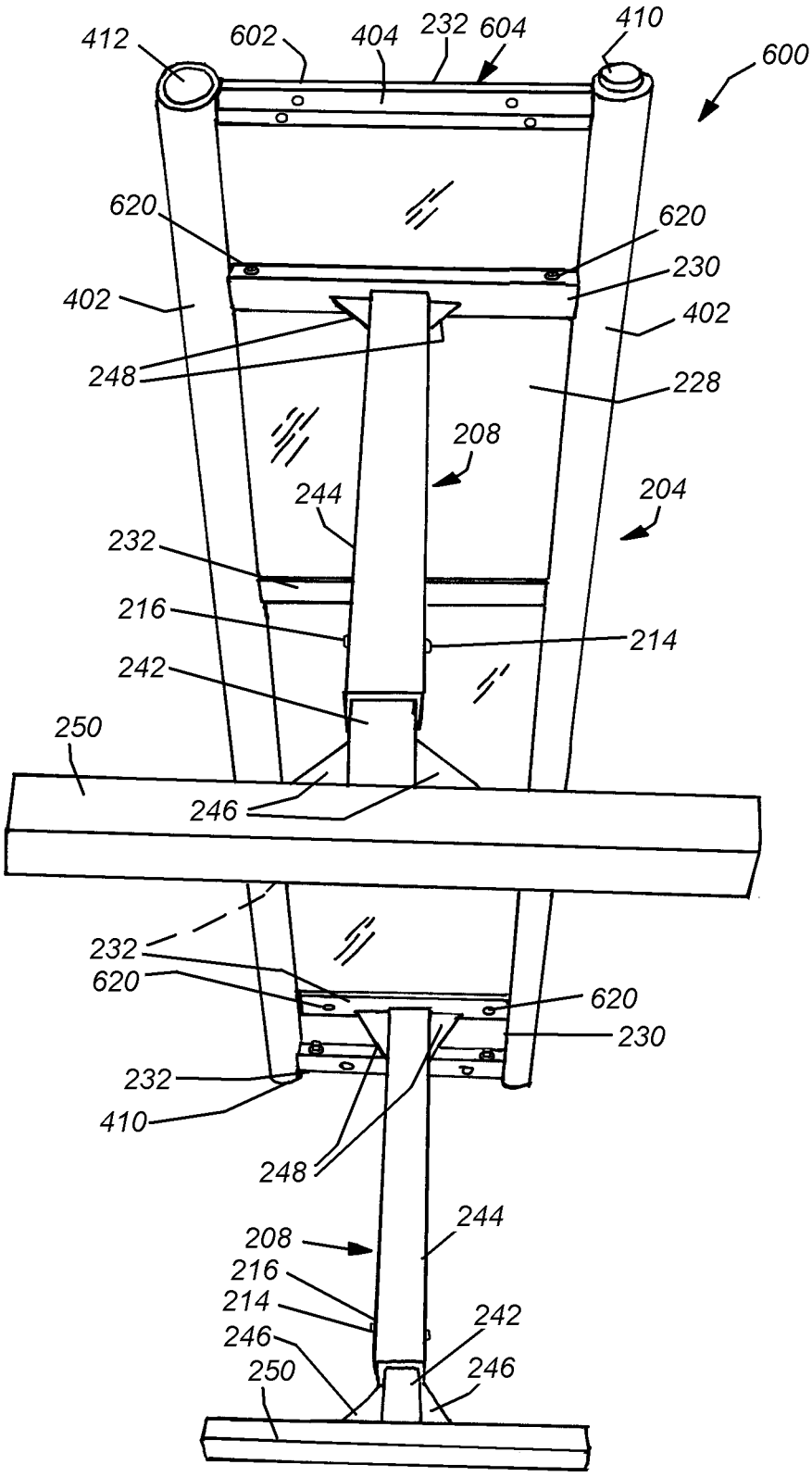
FIG. 6 is an end-on perspective view of the bottom of the portable modular winter sport terrain system of FIG. 2, detailing the structural features.

FIG. 6 is a perspective view 600 of the bottom of the exemplary middle section 204 of the exemplary terrain system of FIG. 2. The middle section 204 is joined to an end cap 206 (not shown) by interaction of the male junction 410 with the opposing female socket of the end cap (not shown) and the female socket 412 with the opposing end cap male junction (not shown). The deck support member 404 is furnished with two through holes 602 and 604 that accept locking bolts (not shown) to secure the end cap to the middle section 204. When the end caps 206 are affixed to the middle section 204, the combination of the respective male junction and female socket elements and locking bolts create in effect a continuous deck and a continuous border. This continuity improves the stability, durability and safety of the overall terrain system.

In addition, while nuts and bolts are used as through-fasteners herein, it is expressly contemplated that cotter-pins, clamps or other fastener types can be used for some or all of the securing functions described above.

Figure 7:
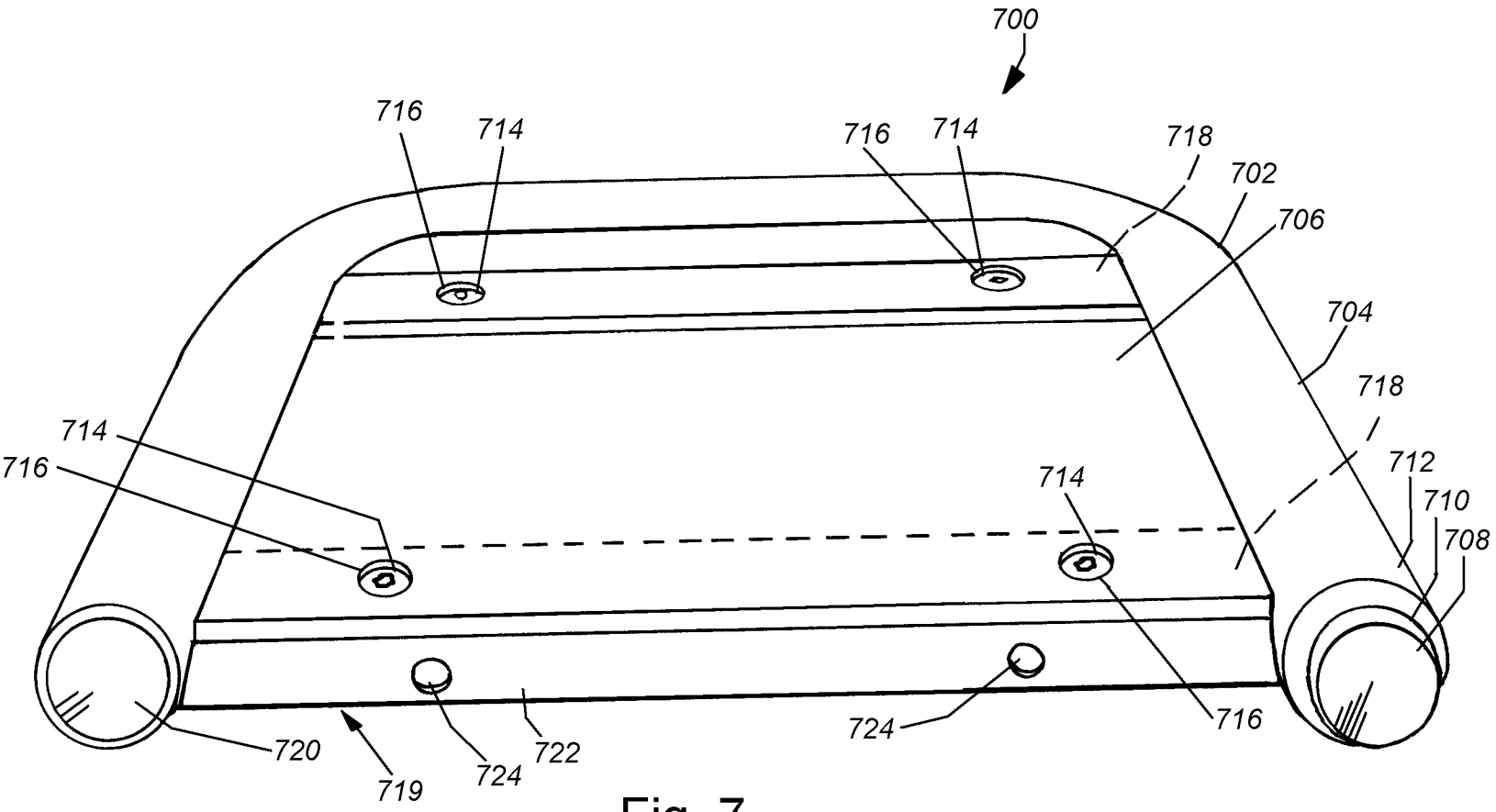
FIG. 7 is a perspective view of the end cap of the illustrative portable modular winter sport terrain system of FIG. 2, detailing the overall features.

FIG. 7 is a view 700 of an exemplary end cap 702 section of the terrain system 204 of FIG. 2. The end cap 702 is comprised of a border 704, deck 706 and support stanchions 718. The tubular portion 710 of the male junction 708 is narrower in diameter than the tubular portion 712 of the border 704. The deck 706 has four holes 714 to accommodate the deck locking bolts 716. These locking bolts secure the deck 706 to the deck support stanchions 718 (shown in phantom lines). In an alternate embodiment, the deck 706 can be furnished with more than four holes 714. As noted above, the locking bolts 716 are fitted so as not to create a secure fit between the deck 706 and the deck support stanchions 718. It is desirable that the deck locking bolt 716 be somewhat loose so as to provide for slight movement up and down and side to side of the deck 706 to accommodate stresses and/or expansion and contraction of the overall structure during temperature changes. This also allows the deck to have a shock-absorbing "floating" capability under stress, which adds to the durability and stability of the overall structure during use by a snowboarder or skier. The end 719 features a support stanchion 722 having two through holes 724 for acceptance of locking bolts to secure the end cap 702 to the middle section (not shown) as set forth in further detail fully above.

Figure 8:
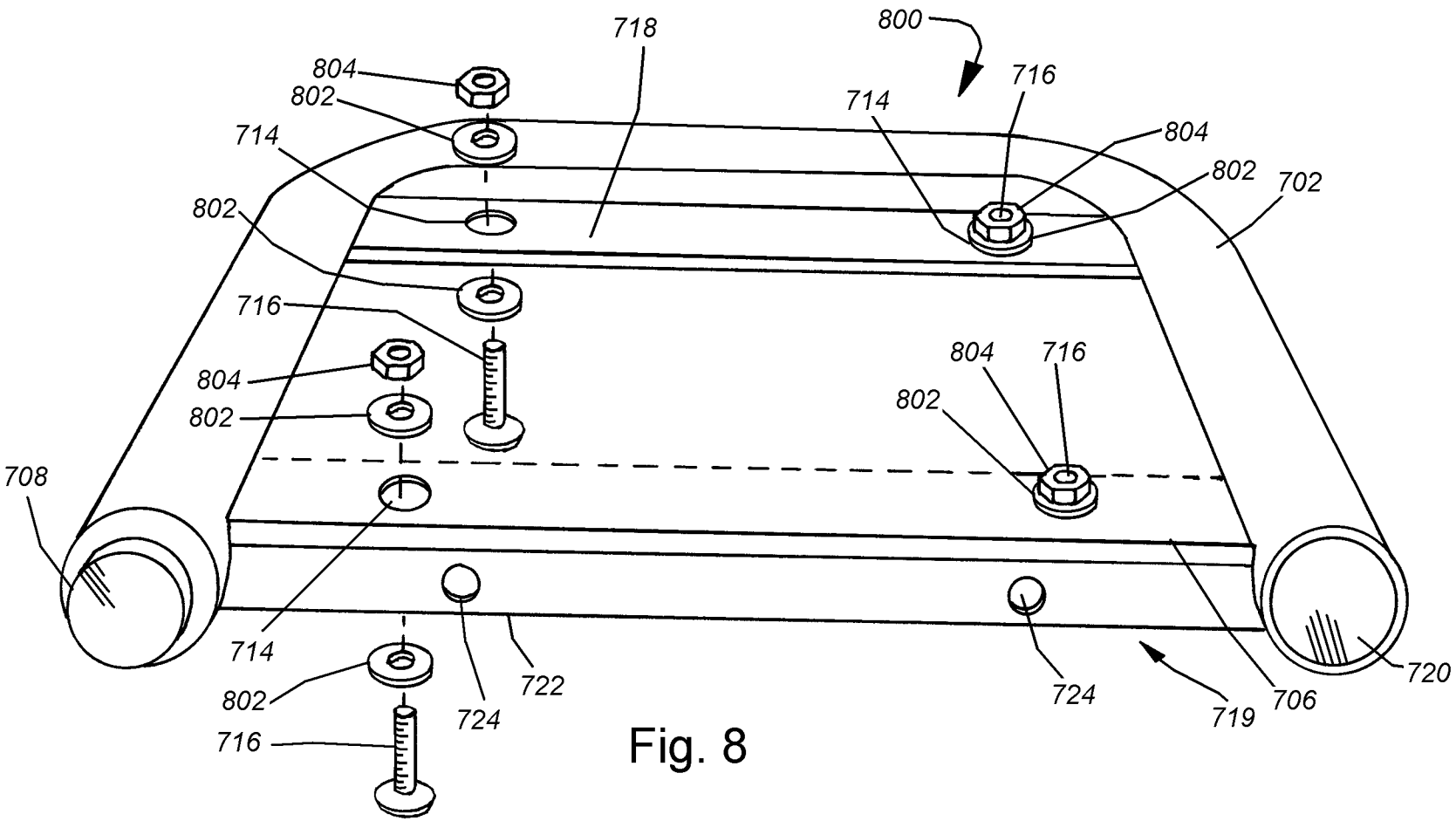
FIG. 8 is a perspective view of the bottom of the end cap of the illustrative portable modular winter sport terrain system of FIG. 2, detailing the underlying features.

FIG. 8 is a view 800 of the bottom of the illustrative end cap 702 of FIG. 7. Two of the deck mounting bolts 714 are depicted in a locked configuration and two of the deck mounting bolts are depicted in an exploded configuration. Deck mounting bolt 716 passes through an elastomeric washer 802 and through the through-hole 714 in the deck support stanchion 718 and 722 through a second elastomeric washer 802 and a retaining locking nut 804. The elastomeric washers facilitate the "floating" movement of the deck as described above.

Figure 9:
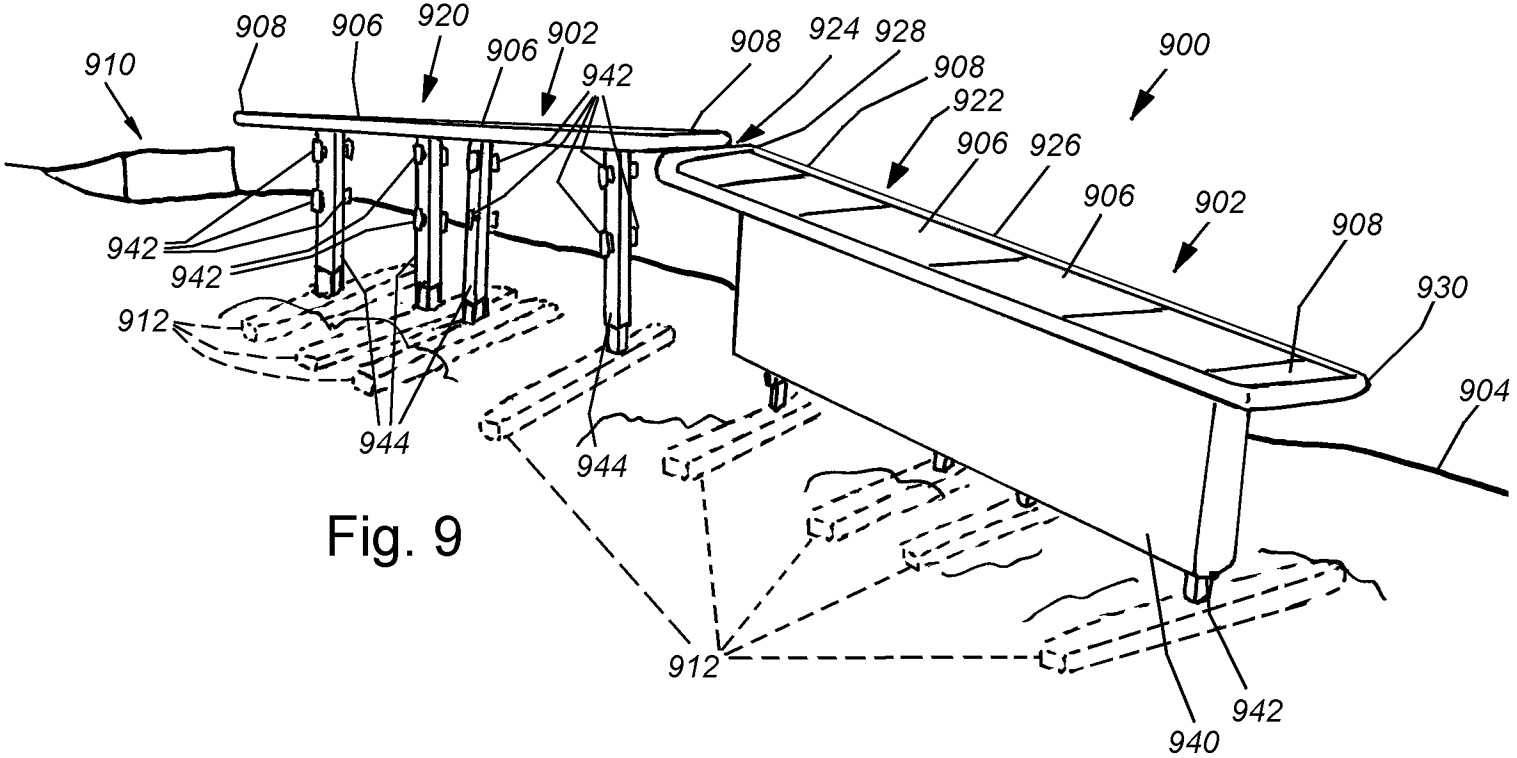
FIG. 9 is a perspective view of two of the illustrative portable modular winter sport terrain systems of FIG. 2 arranged for use in a terrain park implementation, according to an exemplary implementation.

FIG. 9 is a view 900 of two exemplary elongated terrain systems 902, each as shown in FIG. 2, arranged for use in a terrain park implementation, according to an illustrative embodiment. In this embodiment, the terrain systems 902 are deployed and arranged upon a slope 904. Each of the terrain systems 902 is composed of two consecutively joined middle sections 906 and two opposed, outlying end caps 908. A take off ramp 910 is constructed uphill on the slope 904. The outriggers 912 of each terrain system 902 are emplaced within the snow covering the slope 904. In this example, wet snow has been blown onto the outriggers 912 until they have been buried at a depth sufficient to prevent the terrain systems 902 from falling over during use. The outriggers 912 can be emplaced upon a pre-existing built up pile of snow so as create an emplacement that can be secured once the snow is filed on top of the outriggers 912. In this embodiment, the uphill terrain system 920 is set on a slope to have a slight downward pitch. The downhill terrain system 922 is set at a steeper pitch, and there is a gap 924 between the two. The gap 924 is sufficiently narrow to permit a user from tripping or falling between the units 920 and 922. The border 926 is curved, and as such, the uphill edge 928 of the downhill terrain system 922 does not present any sharp or potentially dangerous angles or impediments to the smooth transition of the user from the uphill terrain system 920 to the downhill terrain system 922. When the user has traversed the uphill terrain system 920 and transitioned to the downhill system 922, the user can arrive at the downhill edge 930 of the downhill terrain system 922 and exit the structure, landing on either a still-pitched surface of the slope 904 or a flat portion of the slope 904. It should be noted that in this example, the uphill terrain system 920 and downhill terrain system 922 each have two middle sections 906 of 8 feet in length each and two end caps each of 1 foot in length for a total overall length of each of 18 feet.

In this example, the downhill terrain system 922 has been decorated with removable logo panels 940. These panels have been secured to the terrain system by attachable clips 942 that are secured to the legs 944. The attachment of the clips 942 to the legs 944 can be accomplished with either preset through holes utilizing clips, welded slots or some other method that does not interfere with the functionality of the terrain system and allows for the secure and safe attachment of a logo panel 940 that can be utilized to advertise a particular ski area, sports event, or serve any other promotional need. By way of example, the uphill terrain system 920 can be modified so as to have only one middle section 906 or more than two middle sections 906 and the downhill terrain system 922 can be modified to have one middle section 906 or more than two middle sections 906.

Figure 10:
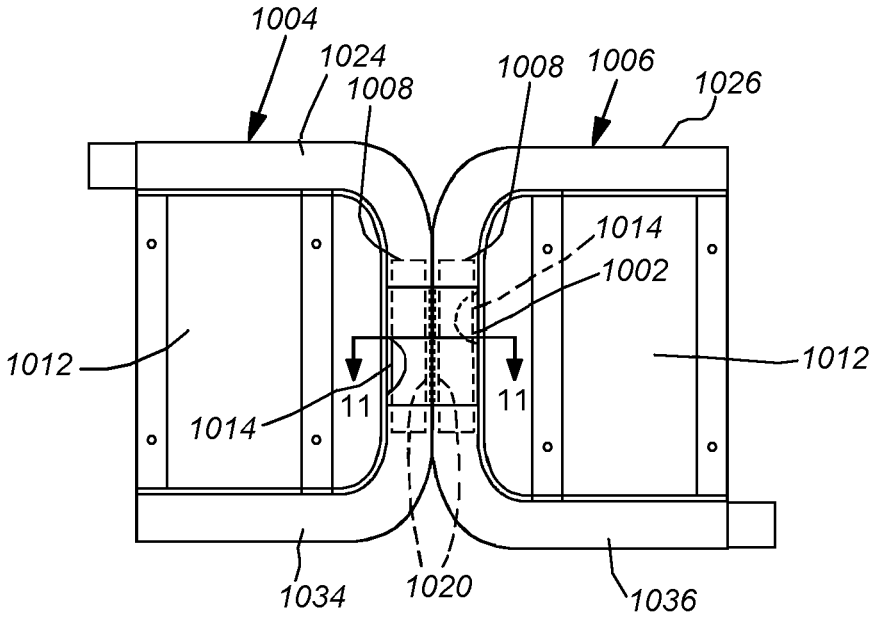
FIG. 10 is an alternate embodiment in which the end caps of two of the illustrative winter sport terrain systems of FIG. 2, are joined by a hinge, according to an illustrative embodiment.
Figure 11:
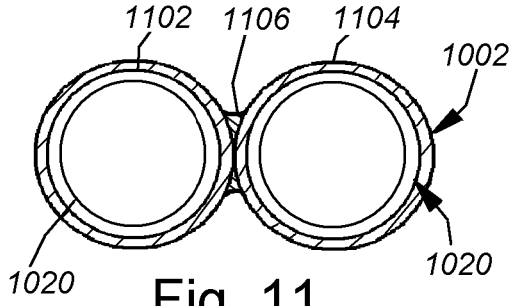
FIG. 11 is a cross-section view of the hinge taken along line 11-11 of FIG. 10.

FIGS. 10 and 11 show an embodiment of a novel hinge assembly (or "hinge") 1002 that links two end caps 1004 and 1006. The hinge is constructed of two tubular segments 1102 and 1104 that are welded together along an axial direction using a linear weld 1106 to define a joined pair of parallel tubes of similar axial length. The hinge tubes 1102, 1104 define an inner and outer diameter, and thickness, that is the same as the end caps, e.g. a 2 mil thickness tubular steel material. The end caps 1004 and 1006 are divided into opposing halves 1024, 1034 and 1026 and 1036 with a central joint 1020 in the region of the hinge tubes 1102, 1104. The joint 1020 on each end cap 1004, 1006 defines a smaller diameter connecting tube that is inserted into the opposing ends 1024, 1026 and 1026 and 1036 and secured in place by welding, fasteners or the like so the two end cap halves on each side are free of rotation or axial translation. Before final securing, the associated hinge tube is slid over the respective joint, and lubrication (grease, for example) is applied. The unit is then permanently or semi-permanently affixed together. Note that the hinge tubes can be provided with holes, slots or cutouts to allow for cleaning, lubrication, and to and facilitates movement. Illustratively, the hinge can be used to join two terrain systems, for example, the two elongated terrain systems of FIG. 9.

Figure 12:
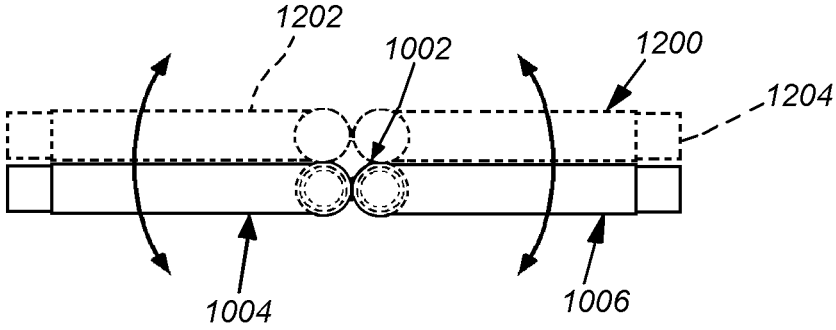
FIG. 12 is a side view of the hinge of FIG. 10, displaying the range of motion.

FIG. 12 is a side view 1200 of the illustrative hinge 1002 of FIG. 10 in which end cap 1004 is joined to end cap 1006. The range of motion for each end cap is up to 180 degrees. In this example, end cap 1006 can be rotated 180 degrees to position 1202, folding on top of end cap 1004. Conversely, end cap 1004 can be moved through a 180 degree range of motion to position 1204 and rest on top of end cap 1006. This range of motion provides for the ability to stack two consecutively joined end caps on top of each other for ease of movement when the hinge 1002 is employed.

Figure 13:
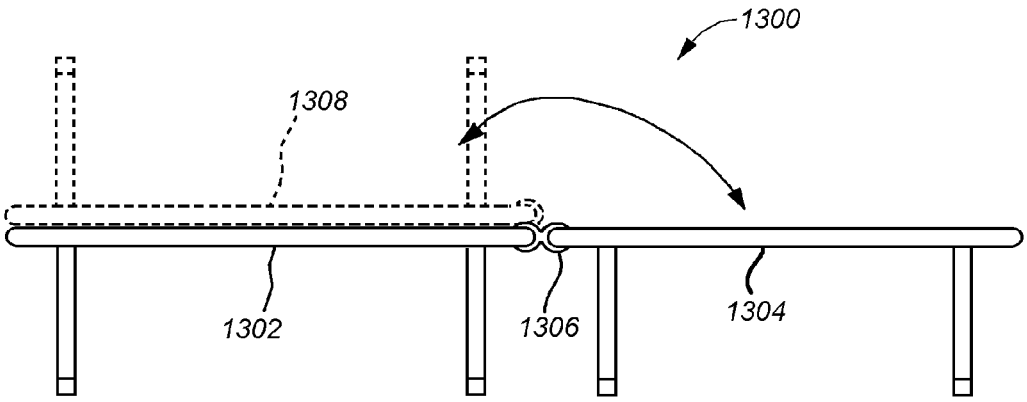
FIG. 13 is an embodiment in which the end caps of two of the illustrative winter sport terrain systems are joined by a hinge, and showing the range of motion for allowing one of the terrain features to be folded onto the other.

FIG. 13 is a view 1300 in which terrain system 1302 and terrain system 1304 are consecutively conjoined by hinge 1306. Terrain system 1304 can be rotated through a range of motion 180 degrees to position 1308 and rest on top of terrain system 1302. In this "stacked" configuration, the two terrain systems can be removed and carried to a new location or placed into storage and remain there in this stacked configuration. This flexibility can also be employed if reconstructive work on the slope beneath terrain system 1302 or 1304 has to be conducted for safety or environmental reasons or to enhance the angle at which the stacked terrain system in position 1308 is employed, after which it can then be folded back down to position 1304.

Figure 14:
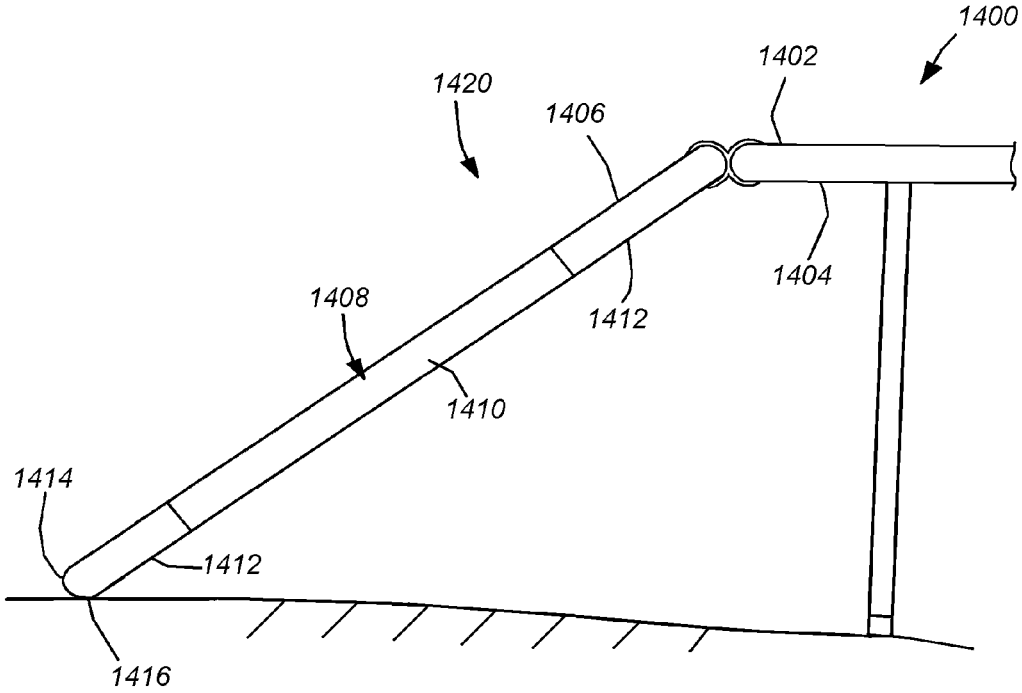
FIG. 14 is an alternate embodiment in which the two of the illustrative winter sport terrain systems are joined by a hinge, with one of the systems being free of supports and used as a takeoff ramp.

FIG. 14 is an alternate embodiment in which the end cap 1402 of terrain system 1404 is joined by a hinge 1406 to a terrain system segment 1408 that is comprised of a middle section 1402 and two end connectors 1412 but is free of supporting legs. This embodiment illustrates the use of an unsupported segment 1408 as a take off ramp. By assembling the terrain system segment 1408 and omitting the legs, the entry edge 1414 of the unsupported terrain system 1408 can function as the start of a take off ramp, and there is the 10-foot long unsupported ramp segment 1408 that takes the user up to the top surface of terrain system 1402. The entry edge 1414 is placed upon the slope 1416 and can be augmented with snow, segments of deck material and the like to provide a smooth transition by the user from the slope 1416 onto the unsupported terrain segment 1408 and then onto the top of terrain system 1402. The use of an unsupported terrain system segment as a ramp allows for variability in the emplacement of the terrain system and facilitates its use in smaller, more congested areas without the necessity of constructing a large take off ramp and having to estimate the appropriate distance from the end of the take off ramp to the top of the terrain system. As noted above, the hinge is composed of a thin tubular steel segment and does not present any major impediment or obstacle to the user as they rise up the entry ramp 1404 and pass over the hinge junction 1406 and onto the top of terrain system 1402. Following use, the entry edge 1414 can be freed from the underlying slope 1406 and the entire entry ramp 1408 can be rotated so as to rest on top of terrain system 1404 for ease in storage or movement as described above.

It should be clear that the novel hinge design of the various embodiments not only allows for desired joining of sections, but also enables users to adjust the joined sections to virtually any desired angle with respect to each other (an approximate 306-degree range of motion). The hinging section can be added inline with the overall structure to provided the desired kink in the rail that allows it to conform to the existing variations in terrain, and/or to provide a user with the needed shape to perform a desired trick.

Figure 15:
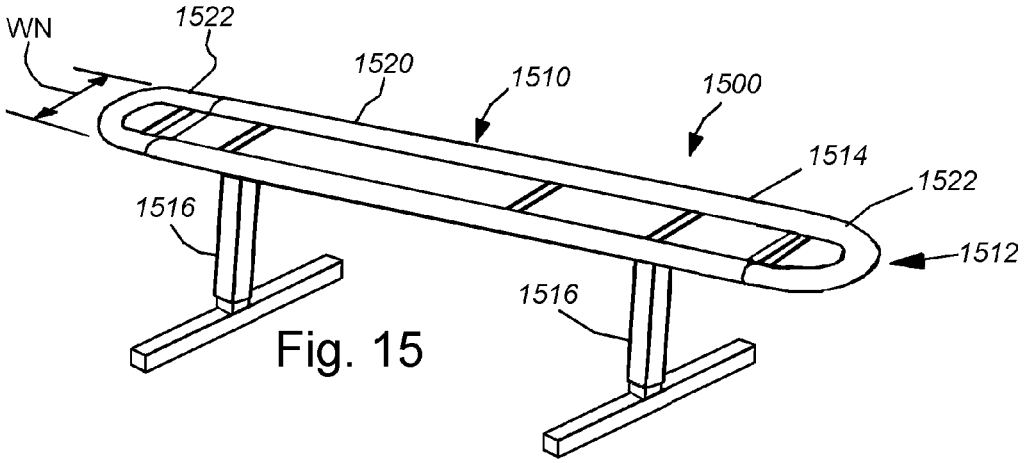
FIG. 15 is a perspective view of a rail system in which a rail system is used in combination with legs of FIG. 2, according to an illustrative embodiment.

FIG. 15 is a view 1500 of a rail system, according to an alternate embodiment of the system in which the upper portion 1510 defines a rail, which is, in essence, a narrower version of the upper portion described above, that may or may not include a narrow deck 1514. The rail in this embodiment is a spaced-apart "double barrel" construction. However, a single barrel rail structure, closely spaced, double barrel structure, or other rail structure is also desirable. The upper portion includes a border 1512. The supporting legs 1516 are the same elements as described above and are portable in the same fashion. The width WN of the terrain system 1510 is approximately 4-12 inches, depending on the desired application. In an embodiment, the rail system 1510 is constructed using an 8-foot long middle section 1520 and two 1-foot long end cap segments 1522 and has the same construction as far as the support for the deck and leg structure as set forth above. However, it is expressly contemplated that the sizes and lengths of the various components can be varied widely to serve the particular application. The middle section 1520 and end cap segments 1522 join together using the male junction and female socket components, secured by bolts, in a manner similar to the system described above, except that the width between all opposing tubes is narrowed accordingly. The legs 1516 are the same legs found in the examples in FIG. 2, above, and are interchangeable with the legs of the wider box terrain system described above. This provides for a substitution of a wider terrain system top with a rail system top, and vice-versa, thereby allowing the user to change the configuration while the legs remain securely in place.

Figure 16:
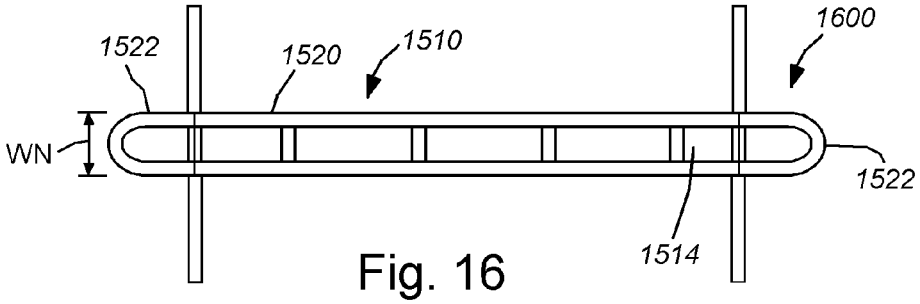
FIG. 16 is a top view of the embodiment of FIG. 15.

FIG. 16 is a top view 1600 of the illustrative rail system of FIG. 15 above, having an overall width WN for the deck 1514 and the borders 1512.

Figure 17:
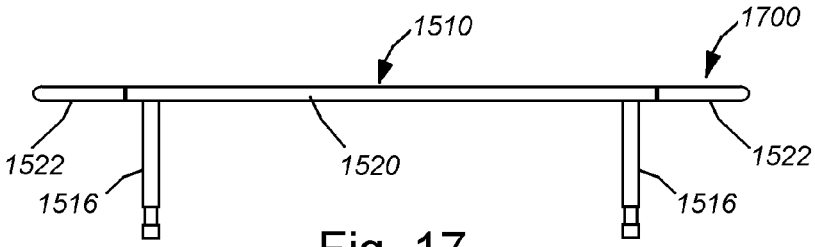
FIG. 17 is a side view of the embodiment of FIG. 15.

FIG. 17 is a side view 1700 of the illustrative embodiment described in FIG. 15 above. The telescoping legs 1516 provide for a range of motion similar to the telescoping legs 208 as set forth in FIG. 2 above.

Figure 18:
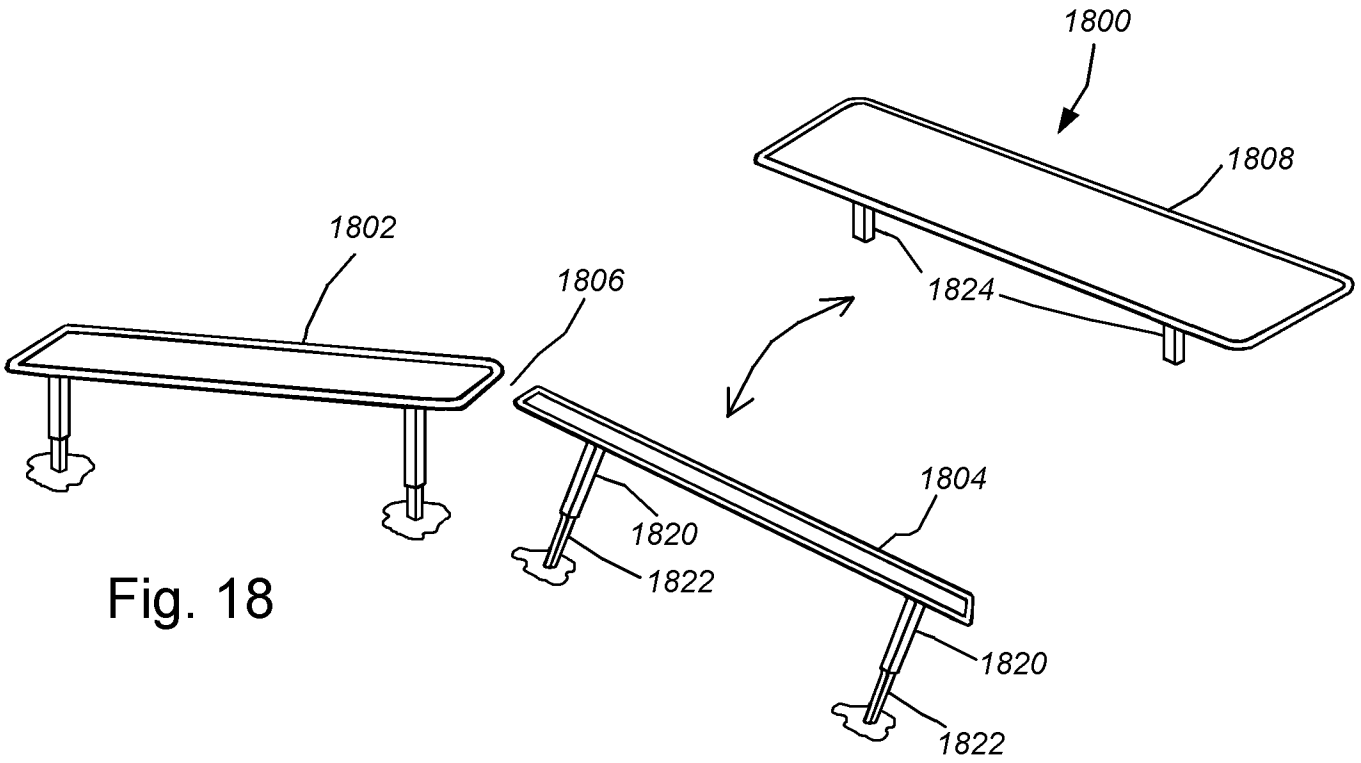
FIG. 18 is a diagram showing the interchangeability of an illustrative box assembly with an illustrative box assembly, according to an embodiment.

FIG. 18 is a view 1800 of an alternate embodiment in which an emplaced wider terrain system 1802 is positioned uphill from a rail system 1804 and separated by a narrow gap 1806. The facilitator has determined to exchange the rail system 1804 for a wider box system top 1808. This can be achieved without removing the lower outriggers 1822 from their retaining shroud of packed snow/ice. The facilitator removes the retaining bolts from the upper leg portion 1820 of each of the legs of the rail system top 1802 and raises it to free it from the emplaced fixed lower legs 1822. The facilitator then maneuvers the replacement wider box system top 1802 and fixes the upper leg portions 1804 onto the already emplaced lower leg portions 1822 and replaces the respective retaining bolts so as to now create a feature that has two wide segments. It is also possible to remove the upper portion of the wide box system 1802 and the lower rail system 1804 and substitute each so that the relative uphill terrain system is narrow and the lower terrain system is wide. Alternatively, additional segments can be added, as well as ramps connected by hinges, as described in FIG. 14 above. Where a hinge is provided between a rail system and a box system, the opposing end caps should provide opposing male junction and female sockets that are sized appropriately for each end.

It should be clear that the above described embodiments provide a highly versatile terrain system that can be extended to indefinite lengths and arranged in a wide range of upward and downward angular orientations. The system affords substantial stability and ease of assembly and disassembly. Significantly, the system is durable, yet is stored very efficiently in a stacked arrangement. Also significant, the above-described modularity of the system affords substantial advantages over conventional box and rail implementations with are often fixed, single purpose structures. That is, a conventional box or rail typically cannot be altered or changed without permanently affecting the structure. Conversely, the modular system of the illustrative embodiments herein can be easily grown in length, changed in direction, and/or rearranged. The illustrative system readily accommodates different skill levels by applying appropriate adjustments. A single installed system can incorporate any variety of features and components. These combinations can then be changed and/or broken down for portability, and stored flat when not in use. Thus, the system can be adapted to new configuration, or multiple configurations in a manner not possible with a single purpose box or rail of the prior art.

The foregoing has been a detailed description of illustrative embodiments of the invention. Various modifications and additions can be made without departing from the spirit and scope of this invention. Each of the various embodiments described above may be combined with other described embodiments in order to provide multiple systems. Furthermore, while the foregoing describes a number of separate embodiments of the apparatus and method of the present invention, what has been described herein is merely illustrative of the application of the principles of the present invention. For example, outriggers can include locations or through holes adapted to receive supplemental ground-securing mechanisms such as stakes, spikes, re-bar, or the like, that are driven into the underlying substrate. Additionally, the legs can be provided with hinge pivots, adjacent to the top portion that allow for folding against the top portion without the need of removal once the unit has been assembled. Through-bolts can be used to lock or unlock the hinging mechanism. Likewise, while the deck can be constructed from a polymer, in alternate embodiments, the deck can be constructed from a natural material, such as finished or unfinished wood or fiberboard. Also, while a double, parallel axis hinge assembly is shown, it is expressly contemplated that a hinge assembly can be constructed with more or fewer pivot axes. Likewise, in various embodiments, the end caps or other structures can include multiple connections to top portions, having the appearance of a railroad turnout. Additionally, end caps can be substituted for other types of joiners that allow for interconnection of predetermined structures. More generally, the dimensions, materials and construction described herein (e.g. thickened materials, full welds, gusseted leg reinforcements, etc.), while illustrative, are expressly contemplated to provide the desired durability to handle the uniquely increased forces encountered in snow sport activities, as opposed to non-snow sports, such as skateboard-riding, and the like. Accordingly, this description is meant to be taken only by way of example, and not to otherwise limit the scope of this invention.

What is claimed is:

1. A terrain system comprising:

a first top portion defining an elongated surface adapted to enable a snow conveyance to slide therealong between opposing ends thereof;

at least two leg bases located on at least two spaced apart positions with respect to the first top portion constructed and arranged to selectively interconnect respective leg assemblies, the leg assemblies each including a bottom outrigger assembly constructed and arranged to stabilize the leg assemblies against tipping and to allow each of the leg assemblies to be implanted in packed snow, the legs including telescoping sections that allow for height adjustability, wherein the first top portion is constructed and arranged to mate with an adjacent second top portion, and wherein at least one of the opposing ends includes an end cap having a hinge assembly that pivotally interconnects to another end cap on the second top portion.

2. The terrain system as set forth in claim 1 wherein the first top portion includes a surrounding set of tubular border members joined by cross supports and a deck joined to the cross supports and residing approximately flush with or beneath apices of the tubular border members.

3. The terrain system as set forth in claim 1 wherein the second top portion includes at least one leg assembly attached thereto, the leg assembly having a respective bottom outrigger assembly and including a respective telescoping section that allows for height adjustability thereof.

4. The terrain system as set forth in claim 1 wherein each of opposing ends of the first top portion includes male and female connection points that mate either with the adjacent second top portion or a curved end cap or joiner.

5. The terrain system as set forth in claim 1 wherein the hinge assembly is constructed and arranged to allow the first top portion and the second top portion to rotate approximately 360 degrees with respect to each other.

6. The terrain system as set forth in claim 1 wherein the hinge assembly comprises a double-axis hinge assembly that allows the top portion and the adjacent top portion to be joined together and articulated along two parallel hinge axes defined by each pivot of the hinge assembly.

7. The terrain system as set forth in claim 1 wherein the first top portion and the legs respectively define a size and a weight that conforms with common carrier shipment requirements.

8. The terrain system as set forth in claim 1 wherein the top portion defines at least one rail.

9. A method for deploying a terrain system comprising the steps of:

positioning (a) a first top portion defining an elongated surface adapted to enable a snow conveyance to slide therealong between opposing ends thereof and (b) at least two attached leg bases located with respect to at least two spaced apart positions of the top portion with respect to the first top portion each including a bottom outrigger assembly on a predetermined terrain surface;

adjusting a height of each of the leg assemblies to provide the top surface with a desired orientation;

mating the first top portion to an adjacent second top portion so as to define a substantially continuous surface along which a snow conveyance can slide, including orienting the second top surface at a desired orientation; and attaching and manipulating a hinge assembly located between the first top portion and the second top portion.

10. The method as set forth in claim 9 further comprising packing snow around the outrigger assemblies to further secure the leg assemblies.

11. The method as set forth in claim 9 further comprising adjusting a height of at least one leg attached to the second top portion.

12. The method as set forth in claim 9 further comprising engaging a male end of the first top portion with a female end of the second top portion.

* * * * *